US007197773B2

(12) United States Patent
Purnell

(10) Patent No.: US 7,197,773 B2
(45) Date of Patent: Apr. 3, 2007

(54) LIGHTWEIGHT, DISASSEMBLABLE AND INTERCHANGABLE PROTECTIVE HEADGEAR FOR WRESTLERS

(76) Inventor: John Purnell, 2908 Chiselford Dr., Sinking Spring, PA (US) 19608

( * ) Notice: Subject to any disclaimer, the term of this patent is extended or adjusted under 35 U.S.C. 154(b) by 180 days.

(21) Appl. No.: 11/007,271

(22) Filed: Dec. 9, 2004

(65) Prior Publication Data

US 2006/0143806 A1 Jul. 6, 2006

(51) Int. Cl.
*A63B 71/10* (2006.01)

(52) U.S. Cl. ..... 2/425; 2/209

(58) Field of Classification Search ..... 2/423, 2/425, 411, 412, 209, 421, 312
See application file for complete search history.

(56) References Cited

U.S. PATENT DOCUMENTS

| | | | | |
|---|---|---|---|---|
| 4,821,345 | A * | 4/1989 | Marchello | 2/425 |
| 5,504,945 | A * | 4/1996 | Purnell | 2/425 |
| 6,058,516 | A * | 5/2000 | Purnell | 2/425 |
| 6,557,186 | B1 * | 5/2003 | Purnell | 2/425 |
| 6,782,558 | B1 * | 8/2004 | Keen et al. | 2/425 |
| 6,986,167 | B1 * | 1/2006 | Coutant et al. | 2/425 |

* cited by examiner

*Primary Examiner*—Rodney Lindsey

(57) ABSTRACT

This invention relates to a protective headgear for use by wrestlers and other athletes who require protective covers for their ears during practice and contests. The headgear provides shock absorbency and protection for the ears and forehead in an easily adjustable and comfortable device that is also disassemblable and interchangeable for ease of repair.

13 Claims, 7 Drawing Sheets

LIGHTWEIGHT, DISASSEMBLABLE AND INTERCHANGABLE PROTECTIVE HEADGEAR FOR WRESTLERS

FIELD OF THE INVENTION

This invention relates to a protective headgear for use by wrestlers and other athletes who require protective covers for their ears during practice and contests. The headgear provides shock absorbency and protection for the ears in an easily adjustable and comfortable device that is also disassemblable and interchangeable for ease of repair.

BACKGROUND OF THE INVENTION

Amateur wrestlers are subjected to maneuvers and contact with opponents and the wrestling mat which can result in injuries to the outer ear surfaces. Such injuries can be the result of unintentional blows to the ear by opponents, abrasion by sliding contact with the mat, i.e., mat burn, and unintentional head contact between opponents, i.e., head butts. As a means of protecting against such injuries, ear protective devices are in wide-spread use and generally provide a pair of reinforced cup shaped protectors designed to cover the ears and connected by a plurality of generally adjustable straps to form a complete headgear wearable by wrestlers during a match.

Reinforced protectors are allowed in high school, college and amateur wrestling leagues in the United States and are well known. Such reinforced ear protectors include those described in the present inventor's prior patents, U.S. Pat. No. 5,504,945 and U.S. Pat. No. 6,058,516 as well as those ear protectors exemplified by Marchello, U.S. Pat. No. 3,596,288 and U.S. Pat. No. 4,821,354, Dubner, et al., U.S. Pat. No. 4,710,985, Keen, U.S. Pat. No. 2,898,596, Johnson U.S. Pat. No. 537,686, Roberts, U.S. Pat. No. 2,277,994 and U.S. Pat. No. 2,886,818, Helm, U.S. Pat. No. 3,311,921, Pukish, Jr., U.S. Pat. No. 3,327,317, and Holden U.S. Pat. No. 3,513,482. However, these protectors are not readily changed or disassembled to facilitate repair or changes in outward appearance to, for example, match uniform colors. In addition some of the prior art ear protectors having rigid shells can themselves cause injury when the shells project through any surrounding padding or other covering.

Accordingly, there is a need in for an ear protector that meets the requirements for protection and safety of wrestlers without rigid shells. It would also be useful if such an ear protector were easily assemblable and disassemblable so as to facilitate changing parts for repair or reconfiguration of the device.

The present invention addresses these needs in an ear protector that meets the international requirement of non-rigidity, while providing sufficient protection, that is fully adjustable to accommodate different sized wrestlers, and that is easily assembled or disassembled to facilitate changing pieces that become worn or broken through use or to change the outward appearance of the ear protector.

SUMMARY OF THE INVENTION

The present invention is an improvement over the prior art and provides an ear protector construction resulting in better protection to both the wearer and his opponent and which provides a degree of shock absorbency not found in similar devices and provides protection without a rigid shell while also providing a greater degree of air flow to the ear. In addition, the invention provides a protective ear guard assembly that is fully adjustable for optimum comfort and protection as well as being easily disassemblable for repair or reconfiguration.

The present invention provides a lightweight disassemblable and interchangeable protective headgear for wrestling comprising, a left side ear protector, a right side ear protector, and a plurality of adjustable straps, forming a wearable assembly, wherein each ear protector comprises an outer cage structure, an inner perforated dome structure, and a peripheral resilient pad, said ear protectors adapted to fit over a wearer's ear whereby said dome structure fits over and receives the wearer's outer ear, said outer cage and said inner dome structures provide shock and blow protection for the wearer's ear and said resilient pad provides cushioning between said ear protectors and the wearer's head.

The present invention further provides a lightweight, disassemblable and interchangeable protective wrestling earguard assembly comprising a pair of matching ear guards, each ear guard comprising;

a semi-rigid outer cage structure comprising a peripheral flange defining a central space and having an inner surface and an outer surface, a plurality of bars extending from said outer surface arcuately upward and over said central space forming a substantially cup shaped cage, and means on said flange to receive a plurality of adjustable straps, a semi-rigid inner dome structure comprising a peripheral flange defining a central space substantially corresponding to said central space of said cage structure and adapted to cooperate with said peripheral flange of said cage structure, a cup shaped center portion extending over said central space and comprising a plurality of spaced ribs connected by an intermediate web, said cup shaped center portion being receivable within said cup shaped cage, and a resilient foam pad substantially corresponding to said flange of said outer cage structure and positionable over said inner surface of said flange of said outer cage structure so as to be disposed between said flange and a wearer's head, whereby said inner dome structure fits within said outer cage structure and said resilient foam pad fits over said flange to form said ear guard whereby said cup shaped center portion of said inner dome structure receives the outer ear of a wearer when said ear guard is placed thereover and said outer cage structure and said inner dome structure cooperate to provide protection for said ear against shock and direct blows.

Thus, it is an object of this invention to provide an improved protective headgear for wrestlers.

It is a further object to provide an improved protective headgear that meets international regulations while providing a degree of shock absorbency and ease of adjustment.

It is a still further object to provide an improved protective headgear that is easily repaired and/or reconfigured.

Further objects and advantages will become evident from the following drawings and descriptions.

DETAILED DESCRIPTION OF THE INVENTION

Figure 1:
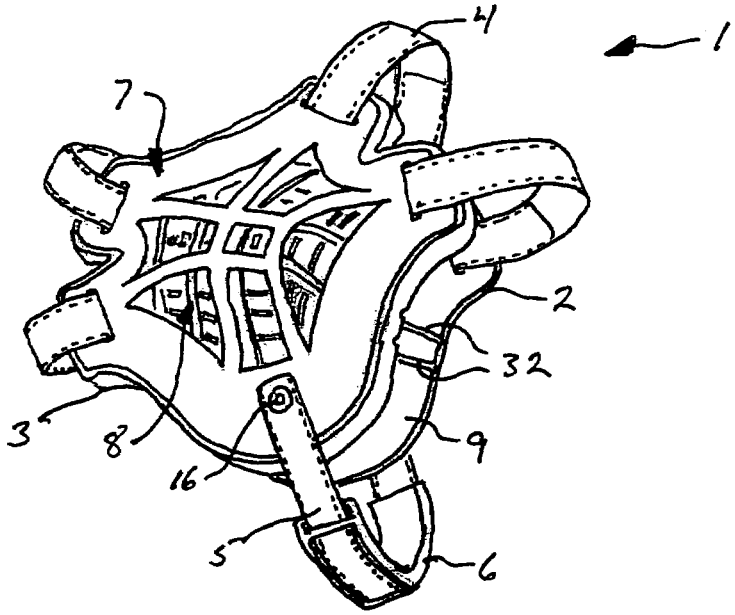
FIG. 1. is a view of the headgear of the present invention.

FIG. 1 illustrates the protective headgear assembly 1 of the present invention as worn by a wrestler. The assembly comprises left and right ear protectors 2 and 3 joined together in wearable form by adjustable head straps 4 and an adjustable chin strap 5, preferably with a resilient foam pad or chin cup 6. Straps 4 and 5 are preferably woven fabric with releasable hook and loop fastenings at each end providing ease of use and adjustment. Chin strap 5 further has releasable fasteners, such as snaps, to engage corresponding snap fasteners 16 on each ear protector.

As shown in FIG. 1, the left and right ear protectors 2 and 3 of the headgear assembly 1 are substantially mirror images and each comprises an outer cage 7, an inner perforated dome 8 and a peripheral resilient pad 9. These three elements fit together in a separable manner such that, by releasing the head straps 4 and chin strap 5, the cage 7, dome 8, and pad 9 may be separated for ease of replacement of any or all three of the elements.

Figure 2:
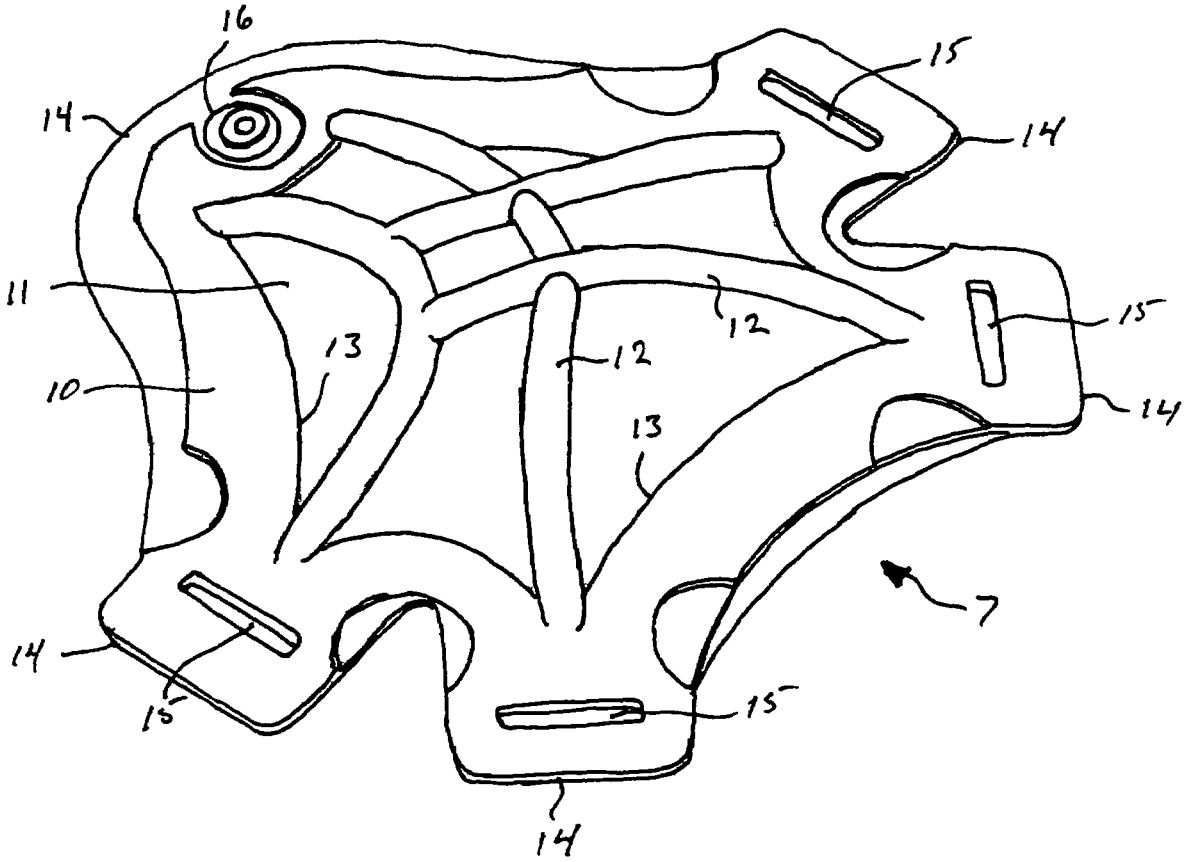
FIG. 2. is a view of the outer surface of the outer cage of the ear protector structure of the present invention.
Figure 3:
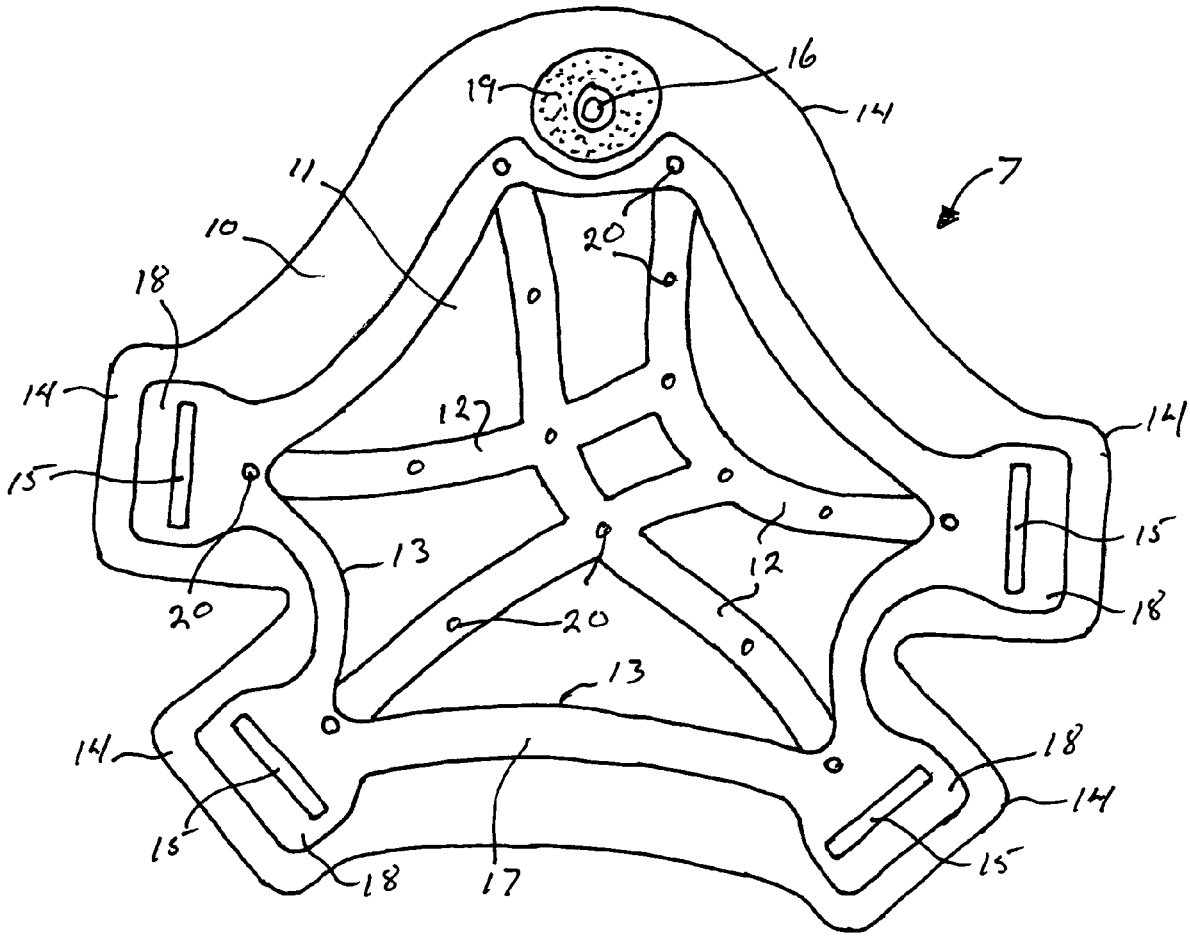
FIG. 3. is a view of the inner surface of the outer cage of the ear protector structure of the present invention.

Turning to FIGS. 2 and 3, the outer cage 7 is molded from a reinforced or non-reinforced polymer, such as polyurethane, polyvinyl chloride, hytrel, thermoplastic urethane, or the like, with a durometer in the range of 70–90, preferably 80–85. Preferably, the polymer is non-reinforced PVC or TPU so as to provide the desired degree of flexibility and resilience for shock absorbance and deflection. If desired, reinforcing material may be incorporated into the polymer when molding the cage 7 for enhanced durability, but it should not be such as to significantly increase the stiffness of the cage 7.

FIG. 2 shows the outer surface of the outer cage 7 which has a peripheral flange 10 defining a central space 11 and a plurality of bars 12 extending arcuately over the central space 11 from the inner edge 13 of the peripheral flange 10 to form the structure of the cage 7. The degree of arc of the bars 12 is sufficient to create a concave space within which to receive the inner perforated dome 8 and, when worn by the user, the outer auricle of the ear.

In plan view, cage 7 has a substantially pentagonal shape defined by five lobes 14. Four lobes 14 are provided with slots 15 for passage of the head straps 4, while the fifth lobe 14 is provided with a snap 16 or other releasable fastener for the chin strap 5. The bars 12 forming the arcuate cage structure over the central space 11 extend from the inner edge 13 of the peripheral flange at each of the lobes 14 and form the outermost surface of the ear protectors 2 and 3. Force exerted against the bars 12 is absorbed by the bars 12 and is directed outward along the bars 12 to the peripheral flange 10.

FIG. 3 shows the inner surface of the cage 7. To accommodate the inner perforated dome 8 when the ear protectors 2 and 3 are assembled, the inner surface of the peripheral flange 10 is molded with a relieved area 17 surrounding the inner edge 13 of the flange 10 and extending into each of the four lobes 14 having slots 15 in the shape of a tab 18 encompassing the slots 15. At the fifth lobe behind the location of snap 16 on the outer surface of the peripheral flange 10 is provided a releasable fastener 19, such as Velcro®, double stick tape, or the like, for releasably affixing the peripheral resilient pad 9 as will be described later.

Relieved area 17 corresponds to a second peripheral flange 21 on the inner perforated dome 8. Spaced around the relieved area 17 and along the underside of bars 12 are a plurality of locating pins 20 which correspond to locating holes 22 formed in the second flange 21 and central cup 23 of the perforated dome 8. Locating pins may be formed with an annular ring or lip at their outer ends to provide a detent for a secure snap fit of locating pins 20 into locating holes 22 when the outer cage 7 and perforated dome 8 are assembled.

Figure 4:
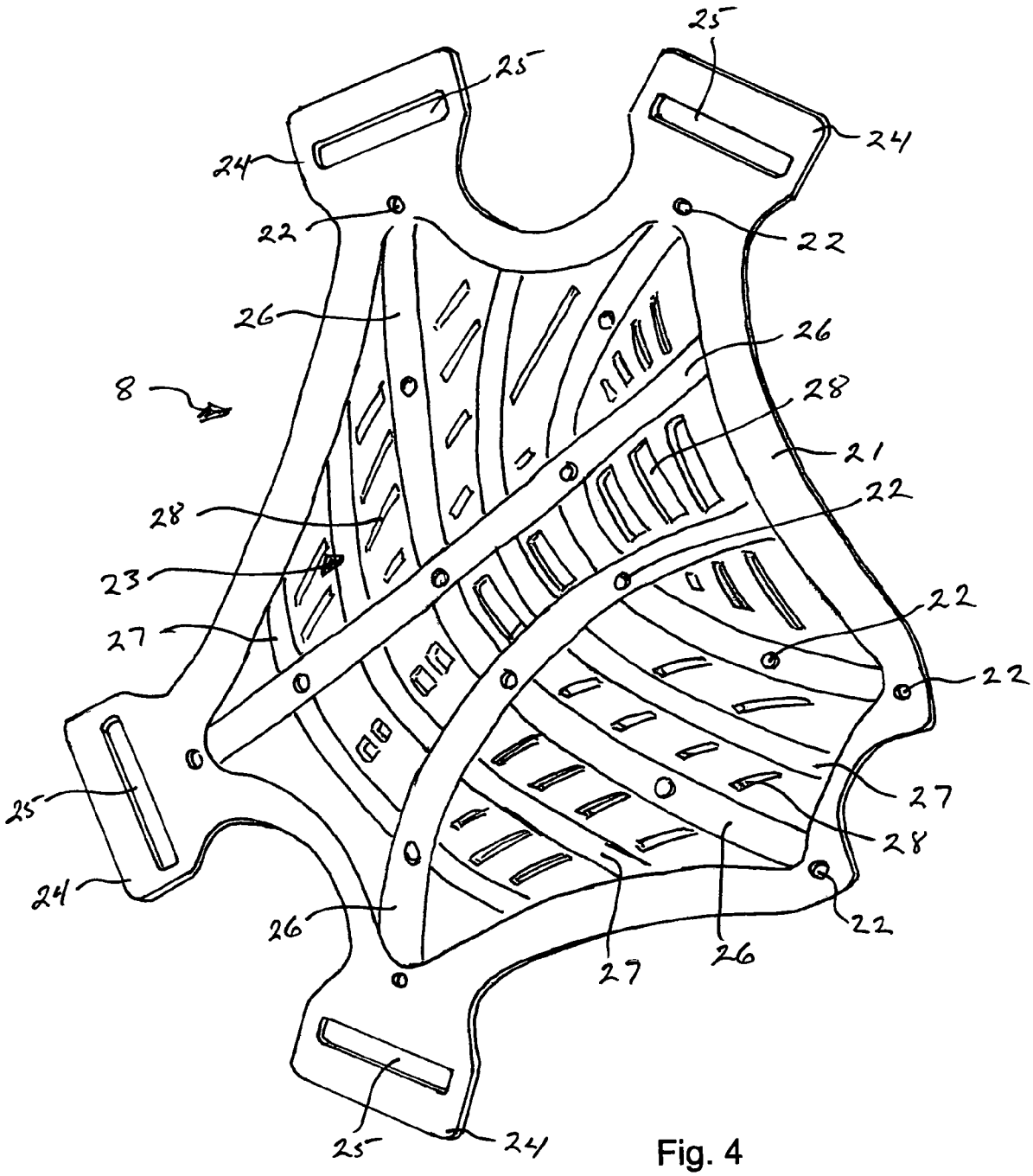
FIG. 4. is a view of the outer surface of the inner perforated dome of the ear protector structure of the present invention.
Figure 5:
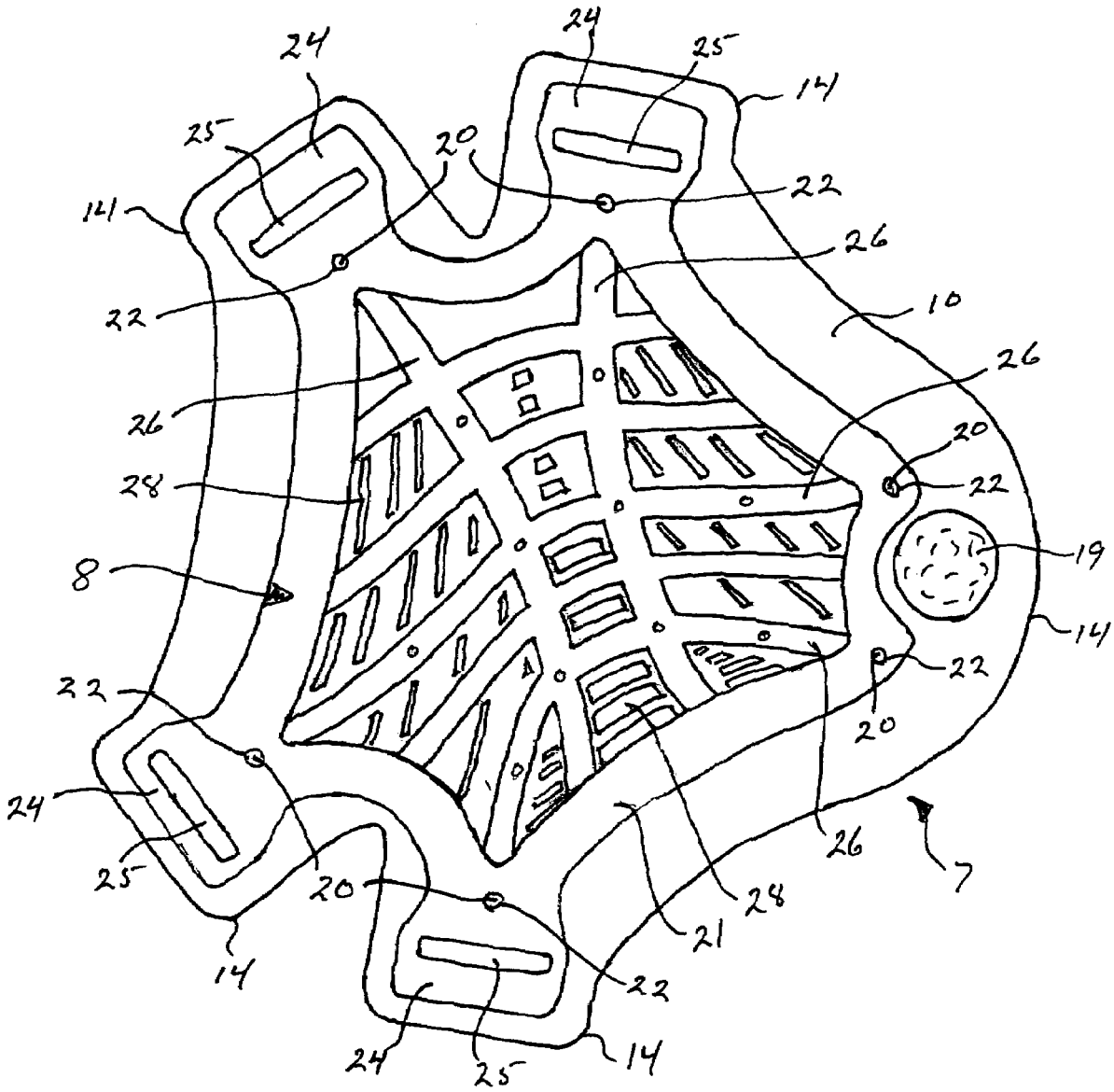
FIG. 5. is a view of the inner surface of the inner perforated dome in place within the outer cage of the ear protector structure of the present invention.

Inner perforated dome 8 is illustrated in FIG. 4 and includes a central cup 23 surrounded by a peripheral flange 21. Central cup 23 provides a concave inner space to fit over the user's ear and itself fits within the corresponding concave space formed by the arcuate bars 12 of outer cage 7. Like cage 7, dome 8 has a substantially pentagonal shape with peripheral flange 21 corresponding to the relieved area 17 on the underside of the peripheral flange 10 of cage 7 so as to fit in and be received by relieved area 17 when cage 7 and dome 8 are assembled. Tabs 24 at four of the corners of peripheral flange 21 correspond to the tab shapes 18 of the relieved area 17 and have slots 25 corresponding to and aligned with slots 15 for passage of the head straps 4 when the cage 7 and dome 8 are assembled.

To provide strength and resistance to crushing while maintaining a degree of resiliency, perforated dome 8 is preferably molded with a plurality of ribs 26 in central cup 23. Ribs 26 correspond in shape and location to the arcuate bars 12 of cage 7 and, in so doing, assist in the direction of forces of shock and compression over the surface of central cup 23 and outward to the peripheral flanges 10 and 21. As shown in FIG. 4, additional or secondary ribs 27 may be included in central cup 23.

In order to provide air flow and pressure relief to the user's ears, dome 8 is provided with a plurality of perforations 28 in the central cup 23 in the spaces between the ribs 26 and secondary ribs 27. The perforations 28 may take any shape but their location and formation should not interfere with ribs 26 or secondary ribs 27.

It has been found that by distributing the perforations 28 substantially evenly over the central cup 23 improved ventilation of the ear is achieved together with improved hearing by the user over other ear protectors having a limited number of ventilation holes located substantially centrally over the ear. In addition, with the wide and even dispersal of the perforations 28 over the whole area of the central cup 23, it is virtually impossible to completely block all of them thus significantly reducing the likelihood of a user suffering damage to the ear drum or ear canal due to a sudden pressure increase within the ear protector caused by a direct blow.

Spaced around the peripheral flange 21 and along ribs 26 are locating holes 22 which correspond to locating pins 20 previously described on outer cage 7. Locating holes 22 receive locating pins 20 when the cage 7 and dome 8 are assembled and, together with the fitting of flange 21 in relieved area 17, serve to ensure proper registration of cage 7 and dome 8. In addition, pins 20 and holes 22 serve to help prevent any relative displacement of cage 7 and dome 8 during use.

Like the outer cage 7, inner perforated dome 8 is molded from a reinforced or non-reinforced polymer such as polyurethane, polyvinyl chloride, hytrel, thermoplastic urethane, or the like. However, the durometer is higher than that of the cage 7, on the order of 90–100 or, preferably, 90–95. Preferably the polymer used is a non-reinforced PVC or TPU.

The third element of the ear protectors 2 and 3 is the peripheral resilient pad 9 which is made from a resilient foam, preferably a closed cell foam of moderate density, most preferably EVA foam having a density of from 0.05 to 1.0 g/cm$^3$ and a thickness of from 1 to 2 centimeters. Although closed cell EVA foam is preferred, other open or closed cell foams may be used such as ensolite, polyethylene, polyurethane and irradiated cross-linked polyethylene. Preferably, the surface of pad 9 has a smooth, low friction surface for strength and comfort. This may be a skin formed on the foam surface during the molding operation or by dipping the finished foam pad in liquid vinyl. Alternatively, a thin, lightweight woven or non-woven fabric cover, such as tricot or Lycra® may be applied.

Figure 6:
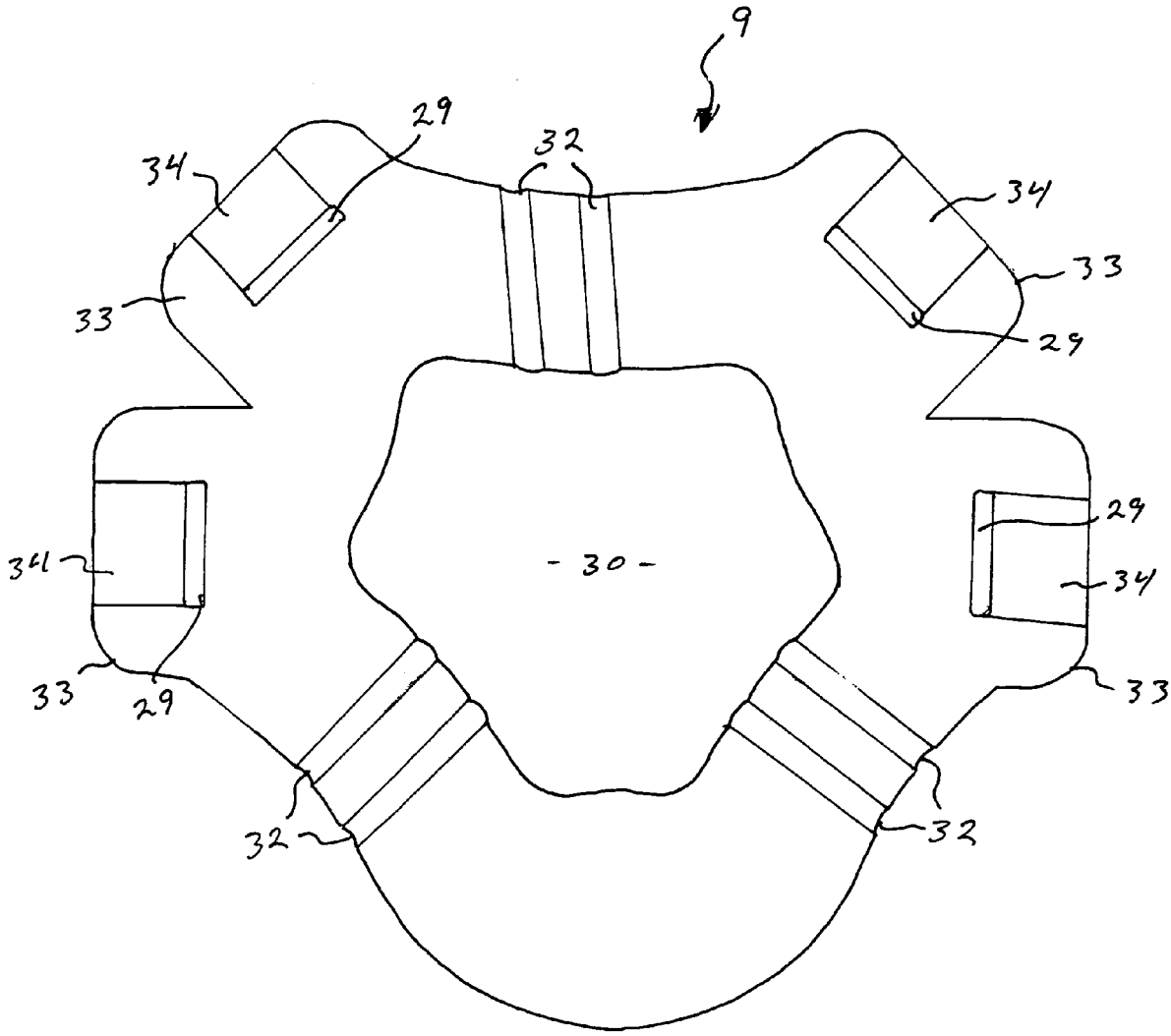
FIG. 6. is a planar view of the underside of the peripheral resilient pad of the ear protector structure of the present invention.
Figure 7:
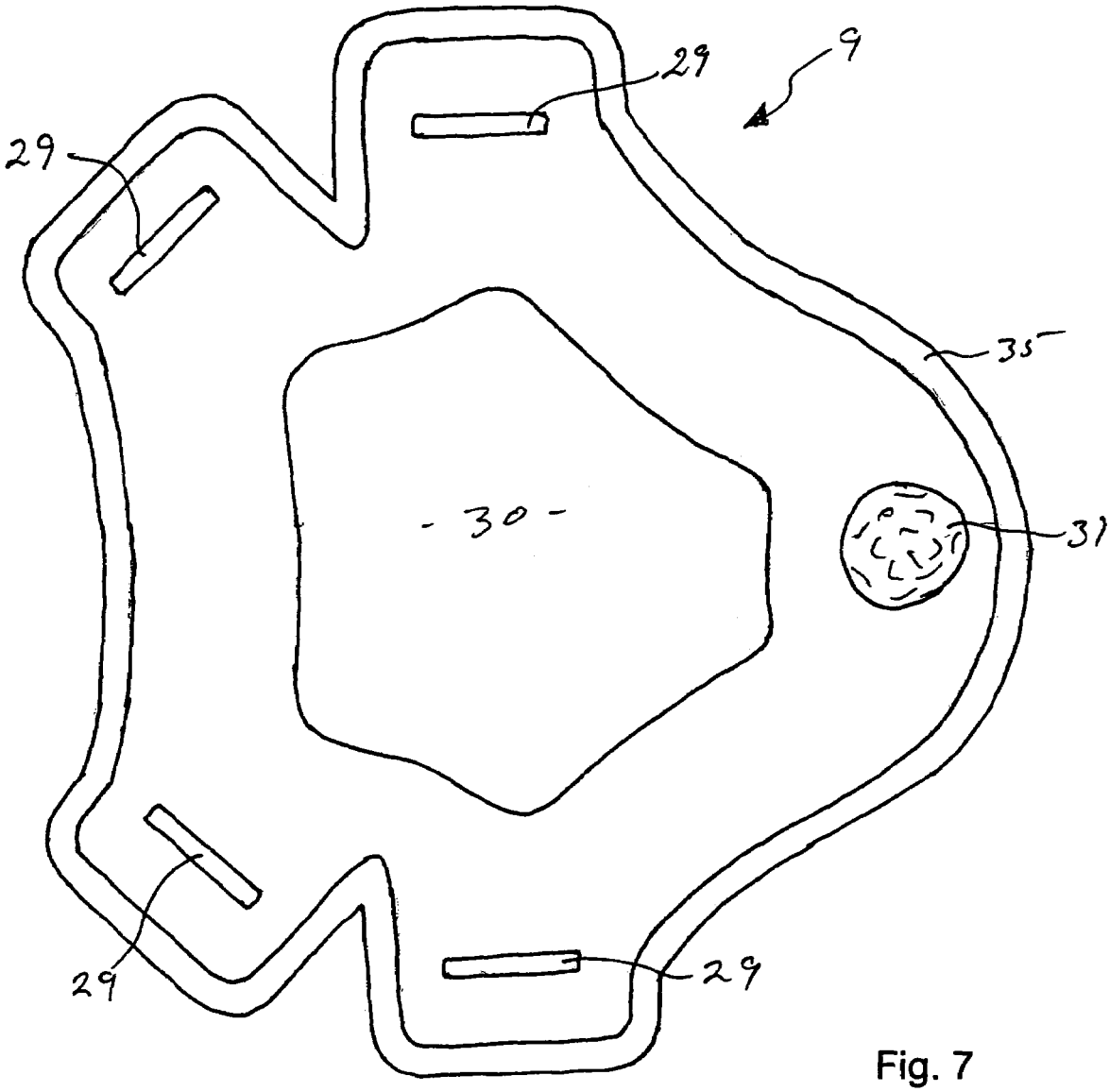
FIG. 7. is a planar view of the upper side of the peripheral resilient pad of the ear protector structure of the present invention.

In its simplest form, peripheral resilient pad 9 substantially conforms to the size and shape of the peripheral flange 10 of cage 7 as shown in FIGS. 6 and 7 and includes slots 29 corresponding to and aligning with slots 15 of cage 7 and slots 25 of dome 8. Head straps 4 pass through all three sets of slots to hold the three elements together as shown in FIG. 1. A central space 30 provides passage of the user's outer ear into the central cup 23 of perforated dome 8. In addition, a releasable fastener 31 which is co-operable with releasable fastener 19 on the cage flange 10 is located on the comparable lobe 33 of pad 9. Thus, when pad 9 is placed against the inner surface of flange 10, releasable fasteners 19 and 31 co-operate to hold the fifth lobe of pad 9 in place against the fifth lobe of flange 10 while the head straps 4 hold the other four lobes in place. In addition, pad 9 presses against flange 21 of dome 8 to aid in its retention within relieved area 17.

In a more preferred form, peripheral resilient pad 9 is slightly larger than the peripheral flange 10 of cage 7 so as to overlap the outer and inner edges of flange 10 thereby providing additional protection.

A particularly preferred embodiment of peripheral resilient pad 9 is shown in FIGS. 6 and 7. In this embodiment, the underside of pad 9 to fit against the side of a user's head and shown in FIG. 6, is provided with air relief channels 32 extending from central space 30 to the outer edge of pad 9. In addition, strap lobes 33 each have a recessed strap channel 34 molded into the foam from the slot 29 to the outer edge of the lobe 33 such that head straps 4 are recessed and less likely to irritate the wearer.

Figure 8:
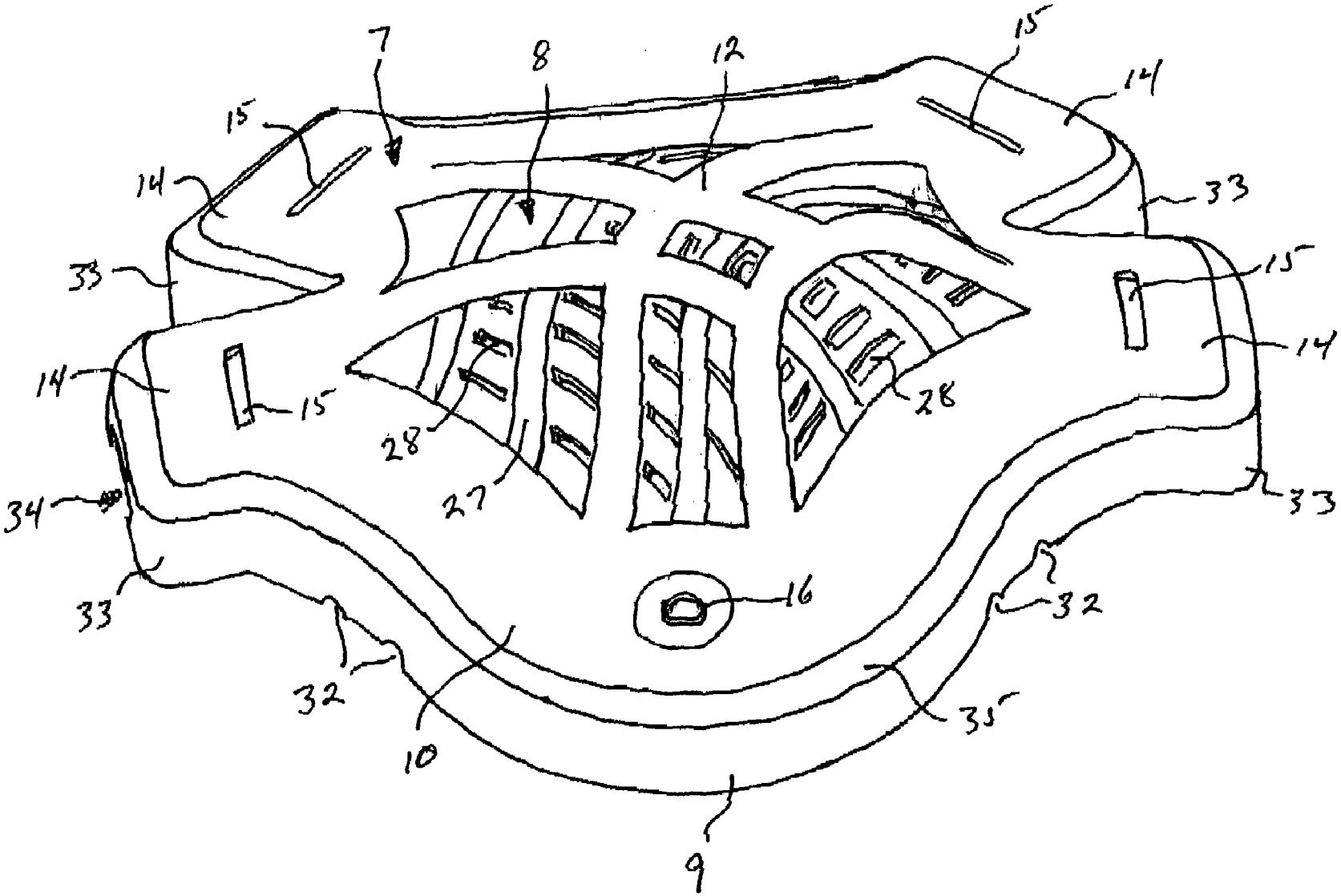
FIG. 8. is an upper oblique view of the assembled ear protector structure of the present invention.

FIG. 7 illustrates the upper surface of the preferred embodiment of pad 9 showing a raised perimeter bead 35 that engages around and cushions the outer edge of peripheral flange 10 of cage 7. For added protection and to further hold pad 9 in place the raised perimeter bead 35 may also have an undercut, thereby forming a recess under the bead 35 to hold the outer edge of flange 10 and permit the bead 35 to roll over the edge of flange 10 as shown in FIG. 8.

The above described construction for ear protectors 2 and 3 provides greater protection for users and the added advantages of being easily disassembled for repair or replacement of parts and meeting the requirements of international wrestling rules.

The structure of the ear protectors provides several levels of shock absorbance. When in use, first contact with the ear protectors is in the bars 12 of the outer cage 7 which, because of their construction and the durometer of the material thereof, undergo a slight compression against the inner perforated dome 8. Simultaneously, the resistance of the dome 8 cause the force of such contact to be directed along the bars 12 to the flange 10 for absorbance by the peripheral foam pad 9.

In the event a sudden shock is applied to the outer surface of the ear protectors 2 and 3, not only is a portion of that shock absorbed and redirected by the structure of the ear protectors 2 and 3 as described above, but, where the force of the shock is sufficient, the central cup 23 of perforated dome 8 will flex also absorbing and directing the shock radially outward along ribs 26 and secondary ribs 27. In this manner, less of the shock and associated pressure is transmitted to the user's ears.

Furthermore, with ventilation provided over substantially the entire area of the central cup 23 of dome 8 and with the bars 12 of cage 7 providing a raised contact surface above the perforations 28, injury as a result of sudden increases in air pressure within the ear protectors due to inadvertent blockage of the air holes common to other ear guards and ear protectors is eliminated.

The structure of the ear protectors and the resulting headgear has added benefits in that it permits the individual elements of the headgear to be manufactured and assembled in a plurality of colors and combinations to match those of national, regional and/or local teams and for completed headgear to be easily customized to a user's preferences. Furthermore, users may easily disassemble the headgear and era protectors for repair and/or replacement of any of the different elements as needed.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed is:

1. A lightweight disassemblable and interchangeable protective headgear for wrestling comprising, a left side ear protector, a right side ear protector, and a plurality of adjustable straps, forming a wearable assembly, wherein each ear protector comprises an outer cage structure, an inner perforated dome structure, and a peripheral resilient pad, said outer cage structure comprises a peripheral flange defining a central space and a plurality of bars extending in a substantially arcuate manner over said central space, said flange including means to receive said adjustable straps, said flange further having an inner surface and an outer surface, said bars extending arcuately upward and across said central space from said outer surface, thereby forming a substantially arcuate cage over said central space, said inner perforated dome structure comprises a peripheral flange defining a central space substantially corresponding to said central space of said outer cage structure and having an inner surface and an outer surface, a cup shaped center portion extending over said central space having a concave inner surface and a convex outer surface, said cup shaped center portion having a plurality of perforations therein and being receivable within said arcuate cage of said outer cage structure, wherein said cup shaped center portion comprises a plurality of arcuate ribs spaced relative to each other and an intermediate web therebetween, said ear protectors adapted to fit over a wearer's ear whereby said dome structure fits over and receives the wearer's outer ear, said outer cage and said inner dome structures provide shock and blow protection for the wearer's ear and said resilient pad provides cushioning between said ear protectors and the wearer's head.

2. The protective headgear of claim 1, wherein said intermediate web is perforated with regularly spaced openings.

3. The protective headgear of claim 2, wherein said flange of said outer cage structure is provided with a circumferential recess in said inner surface about said central space, said recess corresponding in size and shape to said flange of said inner perforated dome structure, whereby said recess is adapted to receive said flange of said inner perforated dome structure when said dome structure is combined with said cage structure to form said ear protector.

4. The protective headgear of claim 3 wherein said recess has a depth corresponding to the thickness of said flange of said dome structure, whereby said inner surface of said cage structure flange and said inner surface of said dome structure flange are flush when said cage structure and said dome structure are assembled.

5. The protective headgear of claim 4 further comprising releasable cooperating fastening means on said cage structure and said dome structure whereby said cage structure and said dome structure are releasably held together in registration when assembled to form said ear protector.

6. The protective headgear of claim 5 further comprising means on said flange of said dome structure to receive said adjustable straps and cooperating with similar means on said cage structure flange.

7. The protective headgear of claim 6, wherein said peripheral resilient pad comprises a layer of foam substantially corresponding to said flange of said outer cage structure and positioned over said inner surface of said flange whereby said pad is disposed between said ear protector and a wearer's head when said headgear is worn.

8. The protective headgear of claim 7 further comprising means on said pad to receive said adjustable straps and cooperating with similar means on said cage structure flange.

9. The protective headgear of claim 8 wherein said pad is a molded foam and has an upward extending bead around its outer periphery, said bead adapted to receive and cushion the outer peripheral edge of said cage structure flange when said cage structure, said dome structure and said pad are assembled to form said ear protector.

10. A lightweight, disassemblable and interchangeable protective wrestling earguard assembly comprising a pair of matching ear guards, each ear guard comprising;

a semirigid outer cage structure comprising a peripheral flange defining a central space and having an inner surface and an outer surface, a plurality of bars extending from said outer surface arcuately upward and over said central space forming a substantially cup shaped cage, and means on said flange to receive a plurality of adjustable straps, a semi-rigid inner dome structure comprising a peripheral flange defining a central space substantially corresponding to said central space of said cage structure and adapted to cooperate with said peripheral flange of said cage structure, a cup shaped center portion extending over said central space and comprising a plurality of spaced ribs connected by an intermediate web, said cup shaped center portion being receivable within said cup shaped cage, and a resilient foam pad substantially corresponding to said flange of said outer cage structure and positionable over said inner surface of said flange of said outer cage structure so as to be disposed between said flange and a wearer's head, releasable registration and fastening means between said cage structure and said dome structure whereby said ear guards are capable of being assembled and disassembled, a recess in the inner surface of said outer cage flange corresponding to and adapted to receive said dome structure flange, said releasable registration and fastening means being located within said recess, whereby said inner dome structure fits within said outer cage structure and said resilient foam pad fits over said flange to form said ear guard whereby said cup shaped center portion of said inner dome structure receives the outer ear of a wearer when said ear guard is placed thereover and said outer cage structure and said inner dome structure cooperate to provide protection for said ear against shock and direct blows.

11. The protective wrestling earguard of claim 10 wherein said resilient foam pad further comprises means to receive and cushion the outer peripheral edge of said outer cage flange.

12. The protective wrestling earguard of claim 11 further comprising a plurality of strap attaching means on said ear guards and plurality of adjustable straps connected between corresponding strap attaching means on each ear guard to form an adjustable wearable assembly for placement on a wrestler's head whereby said ear guards fit over and receive the wrestler's outer ears.

13. The protective wrestling earguard of claim 12, wherein said outer cage structure is molded of a material. having a first resilience and said inner dome structure is molded of a material having a second resilience, said second resilience being stiffer than said first resilience.

* * * * *